United States Patent [19]

Leonhardt et al.

[11] Patent Number: 4,592,477

[45] Date of Patent: Jun. 3, 1986

[54] CLOSURE CAP FOR CONTAINER UNDER PRESSURE

[75] Inventors: Heinz Leonhardt, Bedburg; Otto H. Rhein, Wiesbaden, both of Fed. Rep. of Germany

[73] Assignee: Vaw-Folein-Verarbeitung GmbH, Fed. Rep. of Germany

[21] Appl. No.: 613,874

[22] Filed: May 24, 1984

[51] Int. Cl.[4] ..... B65D 41/04

[52] U.S. Cl. ..... 215/334; 215/354

[58] Field of Search ..... 215/325, 334, 354

[56] References Cited

U.S. PATENT DOCUMENTS

| | | | |
|---|---|---|---|
| 1,849,976 | 3/1932 | Crabbe | 215/334 |
| 2,094,021 | 9/1937 | Penn | 215/334 X |
| 2,170,045 | 8/1939 | Abbotts | 215/334 |
| 3,001,659 | 9/1961 | Schultz | 215/354 X |
| 3,940,005 | 2/1976 | Granat | 215/325 |

FOREIGN PATENT DOCUMENTS

| | | | |
|---|---|---|---|
| 2816811 | 10/1979 | Fed. Rep. of Germany | 215/334 |
| 7703829 | 10/1978 | Netherlands | 325/ |

*Primary Examiner*—Donald F. Norton

*Attorney, Agent, or Firm*—Darby & Darby

[57] ABSTRACT

A mushroom-like closure cap for containers under pressure, such as commercially used glass champagne bottles, made of aluminum or alloys of aluminum, particularly having a volume of 0.5 l, impermeable to gas, easy to reclose, prevents escape of foam when the seal cap is opened and a sharp pressure drop takes place. The mushroom-like closure cap (3) of aluminum metal is affixed to a mushroom stem (4) which has a sealing surface (6) on part B closing the bottle mouth and is corrugated (5) on its part (A) protruding into the bottleneck.

9 Claims, 1 Drawing Figure

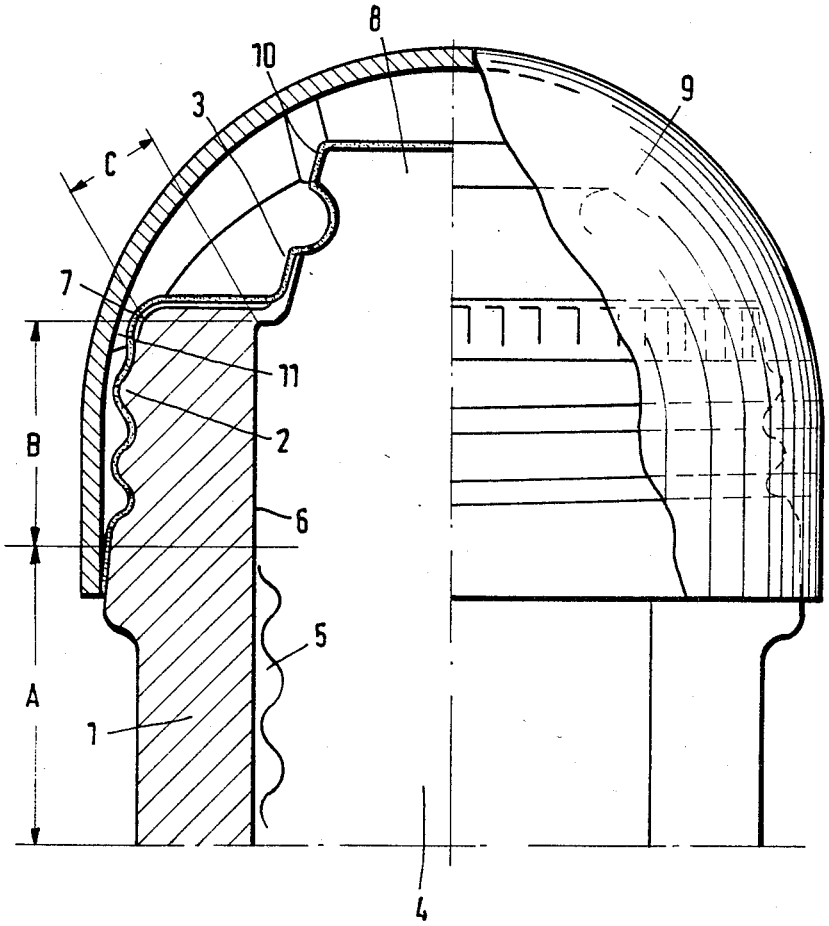
8
10
9
3
C
7
11
2
B
6
5
A
1
4

CLOSURE CAP FOR CONTAINER UNDER PRESSURE

The present invention relates to a closure cap for pressurized containers, e.g. for champagne bottles or the like, in the form of a mushroom, made of aluminum or alloy of aluminum to seal commercially used glass champagne bottles, in particular those having a volume of more than 0.5 l.

Presently, plastic or cork caps are used to seal champagne bottles. These caps have the disadvantage of being not absolutely impermeable to gas, and after a longer period of time the gases and flavors can escape through the plastic or cork.

Furthermore it is known that bottles under lower pressure may be closed by aluminum screw caps. E.g. it is common to use for soda bottles aluminum caps with an inside plastic sealing which screwed onto the bottle mouth provides a gas-tight and reusable cap. But for the bottles under high pressure such a cap is unsuitable. When opening the bottle, the liquid or the foam escapes round the bottle rim and runs over hands and bottle surface.

Therefore it is the object of the present invention to produce an absolutely gas-tight and easy-to-reuse aluminum cap for champagne bottles, which permits opening the bottle accompanied by a sudden drop of pressure, even if the interior of the bottle is under high pressure.

According to the present invention this is accomplished by producing a champagne cap having a mushroom form, the mushroom stem consisting of plastic or cork and being affixed to an aluminum mushroom cap. The mushroom cap has a thread and a sealing surface for the bottle mouth. For the improvement of the anti-skid properties of the cap, the latter has a plastic covering which is affixed to the aluminum mushroom cap.

The advantage of the cap according to the present invention is that during opening the drop of the pressure is effected in sudden bursts as with the known champagne corks.

The stem includes a lower corrugated part A. A sealing wall is included in part B of the stem. The sealing wall acts as a seal when the stem is placed within the mouth of the bottle. This seal is not impermeable to gas but prevents liquid discharge. A gas seal is effected at part C in the bottlemouth, where the aluminum cap according to the present invention forms a flange over the bottlemouth and is covered with a thin plastic layer.

The connection between the mushroom stem and mushroom cap is effected by rolling or overturning of the aluminum cap into a fixed preshaped plastic component of the mushroom stem. A groove is provided in the head of the stem to allow the cap to be rolled onto the stem and thereby secure the cap to the stem. Rolling is the preferred technique because the thread can subsequently be formed into the lower part of the mushroom cap where the cap engages the externally threaded bottleneck using the same rolling equipment, making the capping process more efficient.

The plastic mushroom cap is usually joined to the aluminum mushroom cap by clamping or by the use of adhesive.

During opening of the champagne bottle equipped with the closure cap according to the present invention, no liquid or foam escapes along the mushroom stem to the outside of the bottle even if high pressure prevails inside the bottle. Only when the last course of thread is exposed, a sudden drop of pressure occurs with the simultaneous sudden appearance of foam and liquid, as is customary when opening champagne bottles sealed with natural cork. The hands of the person who opens the bottle stay dry, because the foam issues under pressure from the bottleneck and is not directed laterally by the cap onto the hands.

It is especially advantageous that the cap according to the invention is reusable. After partly emptying the bottle, the mushroom stem can be screwed again into the bottle. The necessary pressure is exerted over the outer thread of the aluminum mushroom cap. Even if the bottle is shaken in half-empty condition and subsequently a higher inner pressure with strong foam formation is builtup, the bottle can be opened without any problem and emptied without splashing of the foam. This is due to the fact that the double sealing at the mushroom stem prevents the premature discharge of foam.

The invention will be explained in more detail in the following example. The figure shows the upper part of the bottleneck with the cap according to the invention (semisectional view).

The mushroom cap (3) made of aluminum is screwed with the thread (2) onto the bottleneck (1). The inside of the bottleneck accomodates a mushroom stem (4), which has a corrugation (5) in part A, a sealing surface (6) in part B. In part C of the mushroom cap (3) there is a plastic sealing surface (7). Mushroom cap (3) and mushroom stem (4) are bonded together by rolling at the head end 8. The outer surface of the aluminum mushroom cap (3) is covered with a plastic cover, which is held in place by the retaining surfaces (10, 11).

What is claimed is:

1. A closure for a container of liquid under pressure, the container having an externally threaded bottleneck and an annular bottlemouth, said closure comprising:
   - a stem having a corrugated lower surface, a middle liquid sealing surface, and a head end, said head end protruding above said bottlemouth when said stem is placed within said bottlemouth; and
   - aluminum-containing cap means for engaging said externally threaded bottleneck, said cap means secured to said head end of said stem and said cap means having a plastic coated annular surface for forming a gas seal with the annular surface of said bottlemouth.

2. The closure of claim 1 wherein said cap means is secured to said head end by rolling.

3. The closure of claim 1 further comprising a plastic covering secured to said cap means and extending with said cap means over said externally threaded bottleneck.

4. The closure of claim 3 wherein said covering is approximately spherically shaped.

5. The closure of claim 3 wherein said covering is adhesively secured to said cap means.

6. The closure of claim 1 wherein said cap means comprises pure aluminum.

7. The closure of claim 1 wherein said cap means comprises an alloy of aluminum.

8. The closure of claim 1 wherein said stem is constructed of plastic.

9. The closure of claim 1 wherein said stem is constructed of cork.

* * * * *

UNITED STATES PATENT AND TRADEMARK OFFICE

CERTIFICATE OF CORRECTION

PATENT NO. : 4,592,477

DATED : June 3, 1986

INVENTOR(S) : Leonhardt, Heinz
Rhein, Otto H.

It is certified that error appears in the above-identified patent and that said Letters Patent are hereby corrected as shown below:

Title page, Reference numeral [73]: delete "Vaw-Folein-Verarbeitung GmbH" and insert therefor -- VAW-Folien-Verarbeitung GmbH --.

Signed and Sealed this

Second Day of September 1986

[SEAL]

*Attest:*

DONALD J. QUIGG

*Attesting Officer*

*Commissioner of Patents and Trademarks*